US005887786A

United States Patent [19]

Sandelman

[11] Patent Number: 5,887,786

[45] Date of Patent: Mar. 30, 1999

[54] PASSIVE INJECTION SYSTEM USED TO ESTABLISH A SECONDARY SYSTEM TEMPERATURE FROM A PRIMARY SYSTEM AT A DIFFERENT TEMPERATURE

[75] Inventor: David Sandelman, Chatham, N.J.

[73] Assignee: Heat Timer Corporation, Fairfield, N.J.

[21] Appl. No.: 925,103

[22] Filed: Sep. 8, 1997

Related U.S. Application Data

[63] Continuation of Ser. No. 601,243, Feb. 14, 1996, abandoned.

[51] Int. Cl.[6] ..... F24D 3/02

[52] U.S. Cl. ..... 237/59; 137/561; 137/599.1

[58] Field of Search ..... 137/561, 599.1; 237/59, 63

[56] References Cited

U.S. PATENT DOCUMENTS

| | | | |
|---|---|---|---|
| 2,020,064 | 11/1935 | Kehm | 237/63 |
| 2,247,972 | 7/1941 | Sullivan | 237/63 |
| 2,836,197 | 5/1958 | Johnson | 137/599.1 |
| 3,870,228 | 3/1975 | Moseley, Jr. | 237/63 |
| 3,968,932 | 7/1976 | Kimmell | 137/599.1 |
| 4,068,681 | 1/1978 | McNair et al. | 137/599.1 |
| 5,119,988 | 6/1992 | Fiedrich | 237/8 C |

FOREIGN PATENT DOCUMENTS

| | | | |
|---|---|---|---|
| 618781 | 4/1961 | Canada | 137/599.1 |

*Primary Examiner*—William E. Tapolcai
*Attorney, Agent, or Firm*—Levisohn, Lerner, Berger & Langsam

[57] ABSTRACT

A passive injection system for a hydronic heating system having a primary loop and a secondary loop is described. The passive injection system establishes a secondary temperature in the secondary loop significantly different from the temperature of the primary or boiler loop. A Venturi tee passively induces flow from the primary loop to the secondary loop. A valve is provided in the flow path of the Venturi tee between the primary and secondary loops and allows some flow or no flow from the primary loop to enter and mix with the secondary loop, depending upon whether the valve is open, closed, or partially open. A return leg is provided at a tee connection for returning flow from the secondary loop to the primary loop. In this way, the temperature of the secondary loop can be set well below the temperature of the primary loop and can be controlled without changing the flow rate of the secondary loop.

19 Claims, 8 Drawing Sheets

((A-B)*E)+(B*D)=C*A

Qb=(1.2)(Cvb)(Qm/Cv)

Qb Flow through branch in GPM
Cv Cv of Venturi Tee
Qm Main Flow in GPM
Cvb Cv of branch

PASSIVE INJECTION SYSTEM USED TO ESTABLISH A SECONDARY SYSTEM TEMPERATURE FROM A PRIMARY SYSTEM AT A DIFFERENT TEMPERATURE

This application is a continuation of application Ser. No. 08/601,243, filed Feb. 14, 1996, now abandoned.

BACKGROUND OF THE INVENTION

This invention relates to hydronic heating systems which transfer a heat medium such as water to heat a radiation device to provide radiant heat. Conventionally, such radiant heat systems may be used in the home or commercially, and when used commercially, they are used to heat large areas such as floors or ceilings.

Conventional hydronic heating systems generally have a primary system in which a boiler is engaged to heat the water and a secondary system into which the water from the primary system flows under certain controlled conditions. Although the system is described with regard to a heating system, it applies equally to a cooling system, in which fluid which is cooled is carried to the radiant system in which a cooling effect is to be achieved.

Transfer of a heated or cooling fluid medium between primary and secondary systems is accomplished by means of multi-port control valves to be described hereinafter. These valves are generally motor controlled, expensive, sometimes complicated and generally undesirable as they require independently generated power, such as through a motor, to move the multi-port valve control system into various positions in order to achieve certain desired heating or cooling effects.

The following is a description of specific prior art hydronic heating systems generally employed. In this description, reference is made to FIGS. 1 through 4.

Hydronic heating systems consist of a boiler 1 used to heat a transfer medium i.e. water, a pump 2 to move the heated transfer medium from the boiler 1 to a transfer device 3 i.e. radiation to transfer the heat from the heated medium to the space to be heated, the heated transfer medium is returned to the boiler 1 at a lower temperature then it left the boiler after transferring some of its heat to the transfer device 3. See FIG. 1.

In a basic hydronic heating system, the boiler 1 heats water to the required temperature needed to be delivered to the transfer device 3 used to heat the space. This transfer device typically would be a cast iron vessel, or a copper tube with fins, that is heated by the passage of heated water through it. In certain applications it is necessary to have the temperature of the water leaving the boiler 1 to be different than the temperature of the water in the radiation system 3. In these types of applications three and four way mixing valves may be used. FIG. 2 shows the piping arrangement of a three way mixing valve.

Depending on the position of the control port in the three way valve 5, all, some, or none of the boiler water flows to the radiation system. When the control port in the three way valve is positioned so that all of the boiler water flows to the radiation system (the 100% position), the boiler port 5*a* is connected to the output port 5*b*, the radiation system 7 receives water at the boiler temperature, there is no flow in the return port 5*c* and all of the flow from the radiation is returned to the boiler. When the valve is in the 100% position the system functions no differently than the system shown in FIG. 1. When the valve is in a 0% boiler water position, the return port 5*c* is connected to the output port 5*b*, the radiation system 7 receives water at the returned water temperature of the radiation system, there is no flow in the boiler port 5*a*. In the 0% boiler position no heat from the boiler 4 is moved to the radiation system 7 and the radiation system remains at the ambient temperature. When the port of the valve is in some mid position, some percentage of the flow is through the boiler port 5*a*, and the remaining percentage of the flow is through the return port 5*c*. By blending also referred to as mixing the water leaving the boiler with water that has lost some of its heat in the radiation, a lower than boiler water temperature may be supplied to the radiation. By varying the boiler port position between 0 and 100%, the temperature supplied to the radiation system may be varied between the ambient temperature of the radiation system and the boiler water temperature. In this configuration the flow through the radiation remains constant but the flow through the boiler varies with the position of the valve. If the varying flow through the boiler presents a problem then a four way valve may be employed to maintain a constant flow through the boiler and radiation in all valve positions. The four way valve is piped into a system as shown in FIG. 3.

In a valve position of 100% boiler water, all boiler water flows into the boiler port 9*a* out to the radiation through the system supply port 9*c*, the water returns from the radiation into the system return port 9*d* and back to the boiler from the boiler return port 9*b*. In a 0% boiler water valve position, boiler water enters the boiler port 9*a* and returns back to the boiler through the boiler return port 9*b*, water in the radiation side of the valve moves out of the system supply port 9*c* and returns back to the valve through the system return port 9*d*, in the 0% boiler water valve position no boiler water is mixed with the water in the radiation system. In positions between 0 and 100% a regulated amount of boiler water mixes with the water moving through the radiation, allowing control of the water temperature going to the radiation between the ambient temperature of the radiation and the boiler water temperature. Both of these systems have what is referred to as a primary and secondary loop, with high temperature water flowing through the primary loop (the boiler loop) and lower temperature water flowing through the secondary loop (the radiation). Another method as shown in FIG. 4 utilizes an additional pump 14 that is controlled at varying speeds to move water from the primary loop 13 to the secondary loop 15, as the pump speed 14 is increased the temperature of the secondary loop can be increased. This system has more complex components than the 3 and 4 way valve systems described above, greater care in piping practices must be used in order to eliminate unwanted flow of heat do to conductive flow, and can not be manually controlled as three and four way valves may be.

The above-described prior art systems, when using both primary and secondary loops require mixing valves which are rather expensive, can be complicated and require power assist such as motors to effect the appropriate operation of the three or four way mixing valve.

An object of this invention is to provide a hydronic heating/cooling system with primary and secondary systems in which the transfer of the heat medium between the primary and secondary systems is accomplished, simply, economically and without the need of additional energy input, such as to a motor.

Another object of this invention is to provide such a system which eliminates using three and four way mixing valves.

Yet another object of this invention is to provide such a system which is easy to repair, comprises simple and well-known components and effectively achieves the desired transfer with minimum complexity and cost.

Other objects and advantages and features of this invention become more apparent from the following description.

DETAILED DESCRIPTION

This invention is an improvement to the prior art methods described above. It utilizes the primary flow of water to induce a flow of water into the secondary loop. The flow of the induced water may be controlled by means of a simple, low cost two-way valve which can manually or automatically be controlled to regulate the temperature of water in the secondary loop.

Figure 1:
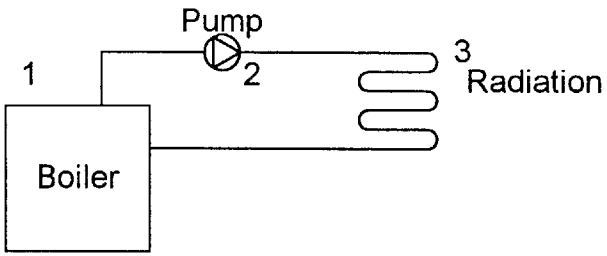
Prior Art Figure 1.
FIG. 1 is a diagram showing the elements of a hydronic heating system of the prior art.
Figure 2:
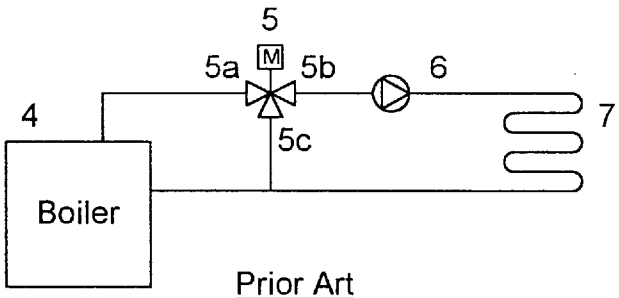
Prior Art Figure 2
FIG. 2 is diagram showing the elements of another prior art hydronic heating system employing a three way valve.
Figure 3:
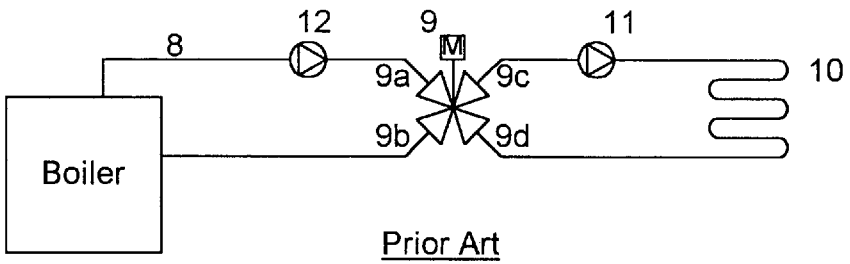
Prior Art Figure 3
FIG. 3 is another diagram of the elements of a prior art hydronic heating system employing a four way valve and also employing prior and secondary loops.
Figure 4:
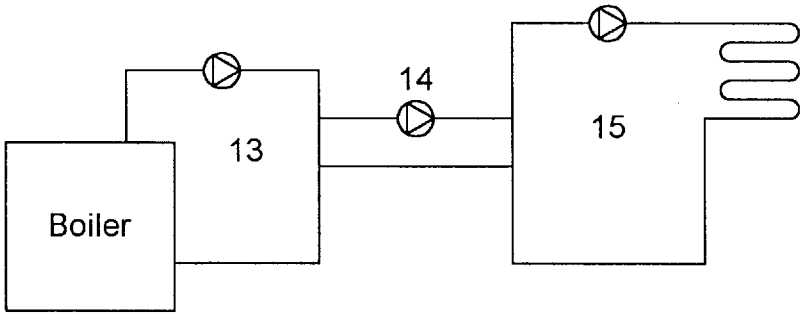
Prior Art Figure 4
FIG. 4 is a diagrammatic representation of yet another prior art system employing primary and secondary loops.
Figure 5:
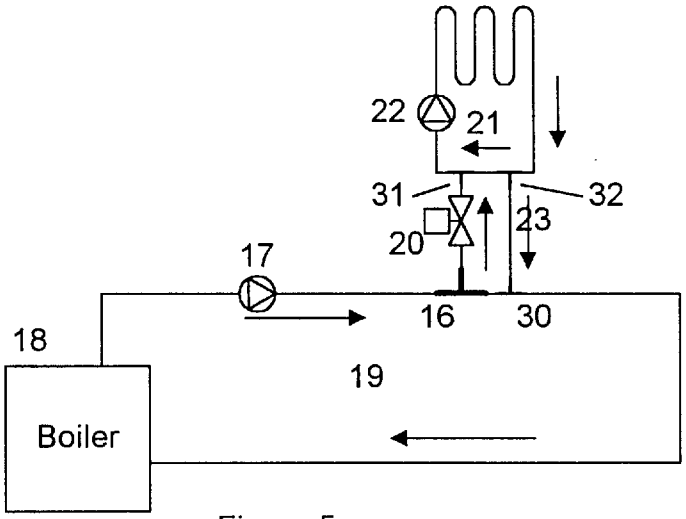
FIG. 5 is a diagrammatic presentation of the elements of the passive injection system of the present invention.

As shown in FIG. 5, the boiler 18 supplies a primary loop 19 through pump 17 with the output of boiler 18 passing through pump 17 and to a Venturi tee 16, the primary loop output of which is joined at a tee connection 30 with one input of the tee connection 30 being the return from a secondary loop 21. The output of tee 30 is returned to boiler 18.

The intermediate output of Venturi tee 16 is supplied to a valve 20 the output of which is supplied to the secondary loop 21 at a tee connection 31. A pump 22 is provided within the secondary loop 21 to circulate the fluid medium, such as water within the loop. A return path 23 between secondary loop 21 and primary loop 19 is effected through a tee connection 32 located at the entry point of return 23, with the tee connected within the secondary loop 21. Flow through return path 23 and valve 20 are always equal.

In a preferred embodiment, the primary loop has a constant flow of water at all times, and for example, the primary flow rate might be in the range of 16–18 gpm. The flow rate in the secondary system, illustratively, is approximately 10 gpm, and the flow rate between the Venturi tee 16 and the input of tee 31 into the secondary system, known as the injection flow rate is approximately 2 gpm and will generally be between 0 and 4 gpm. The temperature in the primary supply loop would be maintained, illustratively, at 180°, and the secondary supply temperature is sought to be between 100° and 120°.

Figure 6:
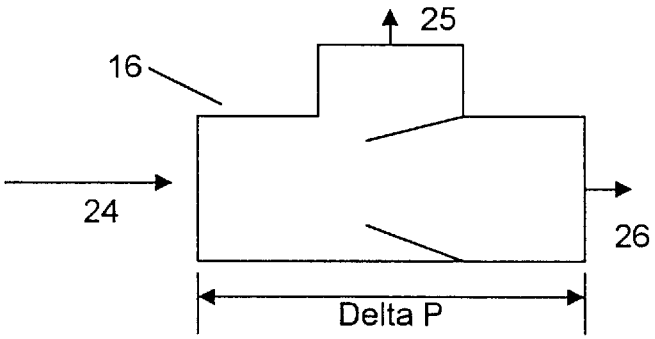
FIG. 6 is a diagram showing the orientation of a Venturi tee used in this invention.

FIG. 6 illustrates the Venturi tee 16 with numeral 24 indicating the output of pump 17, and numeral 26 indicating the flow from the Venturi tee to tee 30 which joins the return 23 before supplying the combined return to boiler 18. 25 is the injection flow output. As illustrated, the Venturi tee has a high pressure end at 24 and a lower pressure end at 26. The difference between those pressures and the difference between the pressure at output 26 and the exit port of tee 32 causes a drawing of fluid along path 23 between the secondary and primary loops. By controlling the flow between the Venturi tee 16 and the secondary loop 21 through the flow control valve 20, the temperature in the secondary loop may be controlled.

The Venturi tee is a passive pressure sensitive apparatus connected between the primary and secondary systems which allows fluid flow between those systems without the need of expensive three and four way valves as described in the prior art.

By use of the Venturi tee 16, the flow in the primary loop 19 created by the primary pump 17 creates a pressure drop across the run of the tee. When the flow control valve 20 is open, boiler temperature water is allowed to flow into the secondary loop 21, an amount of flow equal to the amount of induced flow through the control valve returns back to the primary loop via the return leg 23. When the control valve 20 is closed, no water moves between the primary and secondary loops, and the secondary loop remains at the ambient temperature of the radiation. By varying the induced flow rate by means of the control valve 20 the temperature of the secondary loop may be controlled between the ambient temperature of the secondary loop and below the primary loop temperature.

Figure 7:
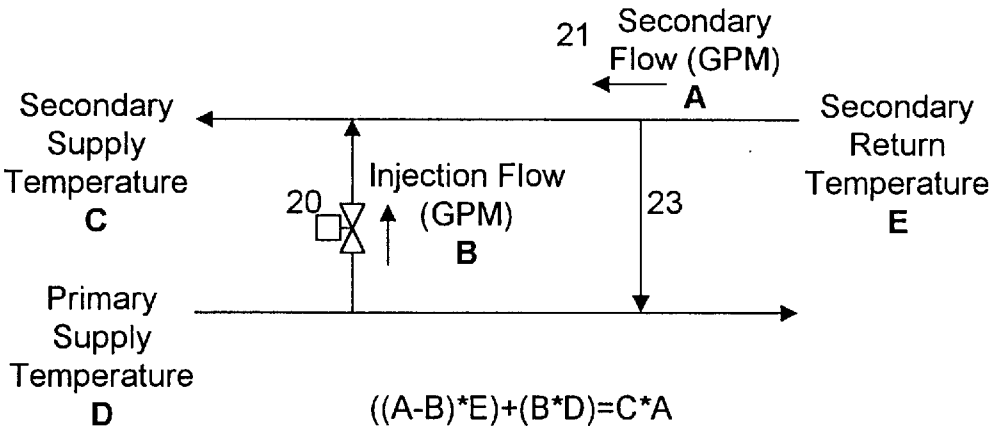
FIG. 7 is a diagrammatic representation of the flows between the primary and secondary loops as accomplished by the invention represented in FIG. 5.

Two equations are used to determine the flows and capacities of the passive injection system. The first equation determines the relationships between flows and temperatures of the primary and secondary temperatures in FIG. 7.

$$((A - B)*E) + (B*D) - C*A \quad 1$$

$$C = \frac{(A - B*E) + (B*D)}{A} \quad 2$$

In the above formula, the secondary supply temperature is achieved by controlling the flow through valve 20 which controls the flow 23, B is adjustable by the valve, while D is fixed. The secondary flow may be fixed by pump 22, but by adjusting valve 20 which is the injection flow rate B, one can achieve an adjustment in the secondary supply temperature C.

Figure 8:
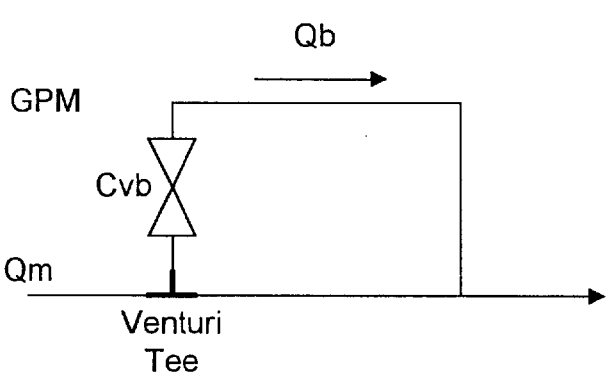
FIG. 8 is a detailed figure illustrating the operation of the Venturi tee between the primary and secondary systems.

FIG. 8 illustrates the equation which governs the flow through valve 20, with $Q_b$ being the valve flow.

$$Q_b=(1.2)(C_{vb})(Q_m/C_v) \quad (3)$$

$Q_b$ Flow through branch in GPM $C_v$ $C_v$ of Venturi Tee $Q_m$ Main Flow in GPM $C_{vb}$ $C_v$ of branch Equation 3 determines the induced flow $C_{vb}$ based on the primary flow $Q_m$ as created by pump 17. As stated above, the primary flow will generally be in the range of 16–18 GPM.

The second equation is used to determine induced flow based on primary flow FIG. 8.

$C_{vb}$ represents all of the cumulative pressure drops through 20, 31, 32, 23 and related piping of the injection loop. The illustration and associated equation in FIG. 8 are not concerned with the flow in the secondary loop 21.

The equation in FIG. 8 determines the amount of injection caused by the Venturi tee 16. $C_v$ in the equation is a function of the internal geometry of a tee. This geometry causes a specific pressure drop across the tee from 24 to 26 for a given flow $Q_m$ which causes a flow through 25 $Q_b$. The amount of this flow is a function of the cumulative pressure drops that make up $C_{vb}$.

With the growing popularity of radiant heating systems, it is more necessary now than in the past to maintain a relatively low secondary temperature as compared to the primary temperature. Unlike convective systems such as finned tube radiators or cast iron radiators that heat the air in a room by convection to keep the occupants warm, radiant heat uses infrared radiation to heat the occupants of the room. Radiant heating systems use large heated areas i.e., the entire floor of a room, or entire ceiling, heated to a temperature generally below 100 degrees Fahrenheit, where a convective system uses temperatures that may approach 200 degrees Fahrenheit. The passive injection system is ideally suited for a radiant heating system where secondary water temperatures of below 100 degrees Fahrenheit are required to be derived from a primary loop temperature of 180 degrees Fahrenheit and above.

In the three and four way valve systems, the boiler may be subjected to thermal shock if the valve is abruptly moved to the 100% boiler position from a 0% or near 0% position, or the injection pump is brought to its maximum flow from a no flow or near no flow speed. Thermal shock is caused by a sudden high volume of relatively low temperature water being introduced into a hot boiler. The passive injection system with the control valve in the full open position always blends high temperature boiler water with low temperature secondary return water before returning the water to the boiler, this helps to protect the boiler from thermal shock.

This invention has been described with reference to a preferred embodiment, while other passive injection systems may be employed which borrow from the teaching of this invention and are covered by the appended claims.

What is claimed is:

1. In a hydronic heating system having a primary system that includes a first fluid recirculating loop and a first pump with fluid at a first temperature, and a secondary system that includes a second fluid recirculating loop and a second pump having fluid at a second temperature, a passive injection system used to establish said secondary temperature in said secondary system from said primary system at said first temperature, said passive injection system comprising:

passive pressure sensitive apparatus connected between said primary and said secondary systems to establish a pressure differential between said primary and secondary systems adapted to induce passive flow between said primary and secondary systems and thereby to allow partial mixing of fluid between said primary and secondary systems; and valve means to control the rate of said passive flow between said primary and said secondary systems to thereby control the secondary system temperature, wherein said second fluid recirculating loop is separate from said first fluid recirculating loop, the fluid in said secondary system moving at a secondary system flow rate and the fluid in said primary system moving at a primary system flow rate, said secondary system flow rate being independent of said primary system flow rate, wherein said passive pressure sensitive apparatus generates a force between said primary and secondary systems related to the relative fluid flow rates of said primary and secondary systems.

2. A passive injection system according to claim 1, wherein said valve means is automatically controlled responsive to ambient temperature conditions.

3. A passive injection system according to claim 1, wherein said valve means can be controlled to control the flow between said primary and secondary systems.

4. A passive injection system according to claim 1, wherein said passive pressure sensitive apparatus comprises a Venturi tee connection.

5. A passive injection system according to claim 2, wherein said passive pressure sensitive apparatus comprises a Venturi tee connection.

6. A passive injection system according to claim 1, wherein said passive pressure sensitive apparatus comprises a Venturi tee connection.

7. A passive injection system according to claim 3, wherein said passive pressure sensitive apparatus comprises a Venturi tee connection.

8. A passive injection system according to claim 4, wherein said Venturi tee comprises a high pressure end, a low pressure end and an intermediate port therebetween, with said Venturi tee connected from the high pressure end to the low pressure end in the direction of flow of fluid in the primary system, and said intermediate port connected to said secondary system.

9. A passive injection system according to claim 5, wherein said Venturi tee comprises a high pressure end, a low pressure end and an intermediate port therebetween, with said Venturi tee connected from the high pressure end to the low pressure end in the direction of flow of fluid in the primary system, and said intermediate port connected to said secondary system.

10. A passive injection system according to claim 6, wherein said Venturi tee comprises a high pressure end, a low pressure end and an intermediate port therebetween, with said Venturi tee connected from the high pressure end to the low pressure end in the direction of flow of fluid in the primary system, and said intermediate port connected to said secondary system.

11. A passive injection system according to claim 7, wherein said Venturi tee comprises a high pressure end, a low pressure end and an intermediate port therebetween, with said Venturi tee connected from the high pressure end to the low pressure end in the direction of flow of fluid in the primary system, and said intermediate port connected to said secondary system.

12. A hydronic heating system, comprising:

a primary loop recirculatingly transferring a heat medium, said primary loop having a boiler and a first pump, said heat medium in said primary loop substantially having a first temperature;

a secondary loop recirculatingly transferring a heat medium, said secondary loop having a heat radiating device and a second pump, said heat medium in said secondary loop substantially having a second temperature lower than said first temperature; and a passive injection system connected between said primary and secondary loops adapted to induce flow between said primary and secondary loops and thereby allow partial mixing of said heat medium in said primary loop and said heat medium in said secondary loop, wherein said secondary loop is separate from said primary loop, the heat medium in said secondary loop moving at a secondary flow rate and the heat medium in said primary loop moving at a primary flow rate, said secondary flow rate being independent of said primary flow rate, wherein said passive injection system generates a force between said primary and secondary loops related to the relative flow rates of said primary and secondary loops.

13. A hydronic heating system according to claim 12, said passive injection system comprising:

a passive pressure sensitive apparatus adapted to create a pressure differential between said primary and secondary loops; and a valve adapted to control the rate of said induced flow between said primary and secondary loops to thereby control said second temperature.

14. A hydronic heating system according to claim 13, said passive pressure sensitive apparatus comprising a Venturi tee having a high pressure end and a low pressure end and an intermediate port, wherein said Venturi tee is connected at its high and low pressure ends to said primary loop with flow of said heat medium in said primary loop moving from said high pressure end to said low pressure end, and wherein said intermediate port is communicable with said secondary loop.

15. A hydronic heating system according to claim 14, wherein said valve is selectively configurable in a range of open, closed, and partially open positions and said valve position determines how much flow is induced through said intermediate port of said Venturi tee.

16. A hydronic cooling system, comprising:

a primary loop recirculatingly transferring a cooling medium, said primary loop having a cooling unit and a first pump, said cooling medium in said primary loop substantially having a first temperature;

a secondary loop recirculatingly transferring a cooling medium, said secondary loop having a heat absorbing device and a second pump, said cooling medium in said secondary loop substantially having a second temperature higher than said first temperature; and a passive injection system connected between said primary and secondary loops adapted to induce flow between said primary and secondary loops and thereby allowing partial mixing of said cooling medium in said primary loop and said cooling medium in said secondary loop, wherein said secondary loop is separate from said primary loop, the cooling medium in said secondary loop moving at a secondary flow rate and the cooling medium in said primary loop moving at a primary flow rate, said secondary flow rate being independent of said primary flow rate, wherein said passive injection system generates a force between said primary and secondary loops related to the relative flow rates of said primary and secondary loops.

17. A hydronic cooling system according to claim 16, said passive injection system comprising:

a passive pressure sensitive apparatus adapted to create a pressure differential between said primary and secondary loops; and a valve adapted to control the rate of said induced flow between said primary and secondary loops to thereby control said second temperature.

18. A hydronic cooling system according to claim 17, said passive pressure sensitive apparatus comprising a Venturi tee having a high pressure end and a low pressure end and an intermediate port, wherein said Venturi tee is connected at its high and low pressure ends to said primary loop with flow of said cooling medium in said primary loop moving from said high pressure end to said low pressure end, and wherein said intermediate port is communicable with said secondary loop.

19. A hydronic cooling system according to claim 18, wherein said valve is selectively configurable in a range of open, closed, and partially open positions and said valve position determines how much flow is induced through said intermediate port of said Venturi tee.

* * * * *